US009466237B2

(12) United States Patent
Kim et al.

(10) Patent No.: US 9,466,237 B2
(45) Date of Patent: Oct. 11, 2016

(54) IMAGE PROCESSOR, DISPLAY DEVICE AND DRIVING METHOD THEREOF

(71) Applicant: Samsung Display Co., Ltd., Yongin, Gyeonggi-Do (KR)

(72) Inventors: Gigeun Kim, Seoul (KR); Ahreum Kim, Hwaseong-si (KR); Yunki Baek, Suwon-si (KR); Yongjun Jang, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 139 days.

(21) Appl. No.: 14/447,495

(22) Filed: Jul. 30, 2014

(65) Prior Publication Data

US 2015/0179094 A1 Jun. 25, 2015

(30) Foreign Application Priority Data

Dec. 23, 2013 (KR) ..... 10-2013-0161712

(51) Int. Cl.
*G09G 3/20* (2006.01)

(52) U.S. Cl.
CPC .... *G09G 3/2044* (2013.01); *G09G 2320/0233* (2013.01); *G09G 2320/0276* (2013.01); *G09G 2320/0673* (2013.01); *G09G 2320/0686* (2013.01)

(58) Field of Classification Search
CPC ..... G09G 3/2044; G09G 2320/0233; G09G 2320/0673; G09G 2320/0686; G09G 2320/0276
USPC ..... 345/690–699
See application file for complete search history.

(56) References Cited

U.S. PATENT DOCUMENTS

| | | | | |
|---|---|---|---|---|
| 6,400,413 | B1 * | 6/2002 | Miyake | G06T 3/4007 348/441 |
| 2004/0046725 | A1 * | 3/2004 | Lee | G09G 3/3607 345/88 |
| 2005/0184952 | A1 * | 8/2005 | Konno | G09G 3/3426 345/102 |
| 2006/0061593 | A1 | 3/2006 | Miura et al. | |
| 2008/0079755 | A1 * | 4/2008 | Shiomi | G09G 3/2003 345/690 |
| 2010/0245397 | A1 * | 9/2010 | Choe | G09G 3/342 345/690 |

FOREIGN PATENT DOCUMENTS

| | | | |
|---|---|---|---|
| JP | 2007-221446 | A | 8/2007 |
| JP | 2007-288304 | A | 11/2007 |
| JP | 2012-053740 | A | 3/2012 |
| KR | 10-0757458 | B1 | 9/2007 |
| KR | 10-2010-0011464 | A | 2/2010 |
| KR | 10-2010-0039760 | A | 4/2010 |
| KR | 10-2011-0124390 | A | 11/2011 |

* cited by examiner

*Primary Examiner* — Kumar Patel
*Assistant Examiner* — Amy C Onyekaba
(74) *Attorney, Agent, or Firm* — Knobbe Martens Olson & Bear LLP

(57) ABSTRACT

An image processing controller, a display device including the image processing controller and a driving method of the display device are disclosed. In one aspect, the method includes receiving an image signal and gamma correcting the image signal into at least one main area image signal. The method also includes interpolating the main area image signal into a boundary area image signal. The method further includes dithering the main area image signal and the boundary area image signal into a data signal and providing the data signal to a display panel.

28 Claims, 10 Drawing Sheets

Mach Band

IMAGE PROCESSOR, DISPLAY DEVICE AND DRIVING METHOD THEREOF

CROSS-REFERENCE TO RELATED APPLICATIONS

This application claims priority from and the benefit of Korean Patent Application No. 10-2013-0161712, filed on Dec. 23, 2013, which is hereby incorporated by reference for all purposes as if fully set forth herein.

BACKGROUND

1. Field

The described technology generally relates to an image processor, a display device and a method of driving the display device.

2. Description of the Related Technology

A liquid crystal display (LCD) has two display substrates and a liquid crystal layer interposed therebetween. An LCD displays a desired image by applying an electric field to the liquid crystal layer, controlling the strength of the electric field, and adjusting the amount of light transmitted through the liquid crystal layer.

Liquid crystal response speed can vary depending on location within the display panel because of factors such as temperature, process profile, etc. Also, brightness of the displayed image can vary according to differences in brightness between backlight units caused by non-uniformity in manufacturing.

SUMMARY OF CERTAIN INVENTIVE ASPECTS

One inventive aspect is a driving method of a display device which comprises receiving an image signal, outputting a main area image signal obtained by performing a gamma correction about the image signal, outputting a boundary area image signal based on the main area image signal, dithering the main area image signal and the boundary area image signal to output a data signal as a dithering result, and providing the data signal to a display panel.

In exemplary embodiments, the outputting a main area image signal comprises outputting a first main area image signal and a second main area image signal, and the first main area image signal and the second main area image signal are image signals to be displayed on first and second main areas of the display panel, a boundary area being interposed between the first and second main areas.

In exemplary embodiments, the boundary area image signal is an image signal to be displayed on the boundary area.

In exemplary embodiments, the outputting a boundary area image signal comprises performing cosine interpolation about the boundary area image signal based on the first main area image signal, the second main area image signal, and a distance between the first main area image signal and the boundary area image signal.

In exemplary embodiments, the outputting a boundary area image signal comprises calculating the boundary area image signal (RGBB) based on the following equation:

$$RGBB = m1 + (m2 - m1) \times \frac{\left[1 - \cos\left(\frac{k \times \pi}{m2 - m1}\right)\right]}{2}$$

wherein "m1" indicates the first main area image signal, "m2" indicates the second main area image signal, and "k" indicates a distance between the first main area image signal and the boundary area image signal.

In exemplary embodiments, the driving method further comprises delaying the main area image signal to output a delayed main area image signal, and the outputting a data signal comprises dithering the delayed main area image signal and the boundary area image signal to output the data signal as a dithering result.

Another aspect is an image processing controller comprising an input buffer which stores an image signal and outputs an intermediate image signal corresponding to a main area, a gamma correction unit which performs a gamma correction about the image signal to output a main area image signal as a result of the gamma correction, a boundary area interpolation unit which interpolates a boundary area image signal based on the main area image signal, and a dithering unit which dithers the main area image signal and the boundary area image signal to output a data signal as a dithering result.

In exemplary embodiments, the image processing controller further comprises a delay unit which delays the main area image signal to output a delayed main area image signal, and the dithering unit dithers the delayed main area image signal and the boundary area image signal to output the data signal as a dithering result.

In exemplary embodiments, the main area image signal comprises a first main area image signal and a second main area image signal, and the first main area image signal and the second main area image signal are image signals to be displayed on first and second main areas of the display panel, a boundary area being interposed between the first and second main areas.

In exemplary embodiments, the boundary area image signal is an image signal to be displayed on the boundary area.

In exemplary embodiments, the boundary area interpolation unit performs cosine interpolation about the boundary area image signal based on the first main area image signal, the second main area image signal, and a distance between the first main area image signal and the boundary area image signal.

In exemplary embodiments, the boundary area interpolation unit calculates the boundary area image signal (RGBB) based on the following equation:

$$RGBB = m1 + (m2 - m1) \times \frac{\left[1 - \cos\left(\frac{k \times \pi}{m2 - m1}\right)\right]}{2}$$

wherein "m1" indicates the first main area image signal, "m2" indicates the second main area image signal, and "k" indicates a distance between the first main area image signal and the boundary area image signal.

In exemplary embodiments, the image processing controller further comprises a gamma memory which stores a gamma correction value, and the gamma correction unit outputs the main area image signal based on the gamma correction value stored in the gamma memory.

Another aspect is a display device comprising a display panel, and an image processing controller configured to control an image to be displayed on the display panel. The image processing controller comprises an input buffer which stores an image signal and outputs an intermediate image signal corresponding to a main area, a gamma correction unit which performs a gamma correction about the image signal to output a main area image signal as a result of the gamma correction, a boundary area interpolation unit which interpolates a boundary area image signal based on the main area image signal, and a dithering unit which dithers the main area image signal and the boundary area image signal to output a data signal as a dithering result.

In exemplary embodiments, the image processing controller further comprises a delay unit which delays the main area image signal to output a delayed main area image signal, and the dithering unit dithers the delayed main area image signal and the boundary area image signal to output the data signal as a dithering result.

In exemplary embodiments, the main area image signal comprises a first main area image signal and a second main area image signal, and the first main area image signal and the second main area image signal are image signals to be displayed on first and second main areas of the display panel, a boundary area being interposed between the first and second main areas.

In exemplary embodiments, the boundary area image signal is an image signal to be displayed on the boundary area.

In exemplary embodiments, the boundary area interpolation unit performs cosine interpolation about the boundary area image signal based on the first main area image signal, the second main area image signal, and a distance between the first main area image signal and the boundary area image signal.

In exemplary embodiments, the boundary area interpolation unit calculates the boundary area image signal (RGBB) based on the following equation:

$$RGBB = m1 + (m2 - m1) \times \frac{\left[1 - \cos\left(\frac{k \times \pi}{m2 - m1}\right)\right]}{2}$$

wherein "m1" indicates the first main area image signal, "m2" indicates the second main area image signal, and "k" indicates a distance between the first main area image signal and the boundary area image signal.

In exemplary embodiments, the image processing controller further comprises a gamma memory which stores a gamma correction value, and the gamma correction unit outputs the main area image signal based on the gamma correction value stored in the gamma memory.

According to some embodiments, as a boundary area between main areas is interpolated according to a cosine interpolation method, such a phenomenon that a lightness difference is perceived at a boundary area between main areas can be minimized. Also, the display quality of an image can be improved by dithering a gamma-corrected main area image signal and a cosine-interpolated boundary area image signal.

DETAILED DESCRIPTION OF CERTAIN INVENTIVE EMBODIMENTS

Figure 1:
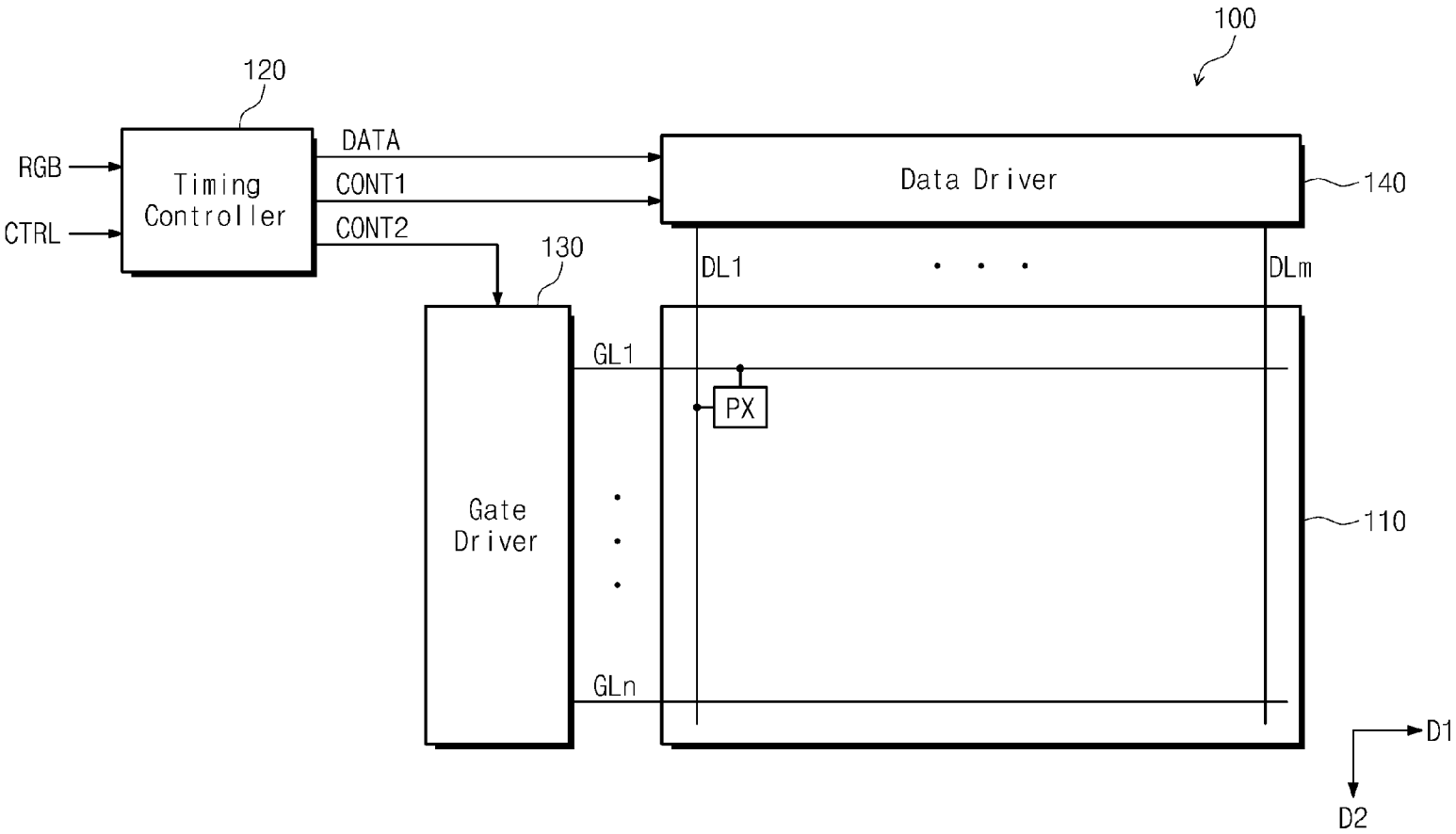
FIG. 1 illustrates a block diagram of a display device according to an embodiment.

Recently, display panel brightness has been corrected by processing image signals fed to pixels in predetermined display regions. However, when image signals are corrected using a different correction value for each region, a difference in brightness can be perceived at region boundaries.

The described technology is described more fully hereinafter with reference to the accompanying drawings, in which exemplary embodiments are shown. This described technology can, however, be embodied in many different forms and should not be construed as limited to the exemplary embodiments set forth herein. Rather, these exemplary embodiments are provided so that this disclosure is thorough, and will fully convey the scope of the described technology to those skilled in the art. In the drawings, the size and relative sizes of elements can be exaggerated for clarity. Like reference numerals in the drawings denote like elements.

It will be understood that, although the terms "first", "second", "third", etc., can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the described technology.

Spatially relative terms, such as "beneath", "below", "lower", "under", "above", "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device can be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers can also be present.

The terminology used herein is for the purpose of describing particular embodiments only and is not intended to be limiting of the described technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers can be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this described technology belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein. In this disclosure, the term "substantially" means completely, almost completely or to any significant degree. Moreover, "formed on" can also mean "formed over."

FIG. 1 illustrates a block diagram of a display device 100 according to an embodiment.

Referring to FIG. 1, the display device 100 can include a display panel 110, a timing controller 120, a gate driver 130, and a data driver 140.

The display device 100 can be a liquid crystal display (LCD), a plasma panel display (PDP), an organic light-emitting diode (OLED) display or a field emission display (FED).

The display panel 110 includes a plurality of gate lines GL1 to GLn extending along a first direction D1, a plurality of data lines DL1 to DLm extending along a second direction D2, and a plurality of pixels PX respectively electrically connected to the data lines DL1 to DLm and the gate lines GL1 to GLn. The data lines DL1 to DLm and the gate lines GL1 to GLn can be substantially isolated from each other. Each pixel PX can include a switching transistor (not shown) electrically connected to a corresponding data line and to a corresponding gate line. Each pixel can also include a crystal capacitor (not shown) and a storage capacitor (not shown) electrically connected to the switching transistor.

The timing controller 120 can receive an image signal RGB and a control signal CTRL for controlling a display of the image signal RGB. The control signal CTRL can include a vertical synchronization signal, a horizontal synchronization signal, a main clock signal, a data enable signal, etc. The timing controller 120 can provide a data signal DATA to the data driver 140, and the data signal DATA can be generated by processing the image signal RGB to be suitable for an operation condition of the display panel 100. Based on the control signal CTRL, the timing controller 120 can provide a first control signal CONT1 to the data driver 140 and a second control signal CONT2 to the gate driver 130. The first control signal CONT1 can include a horizontal synchronization start signal, a clock signal, and a line latch signal. The second control signal CONT2 can include a vertical synchronization start signal and an output enable signal.

The timing controller 120 can output a main area image signal by performing gamma correction on the image signal RGB. The timing controller 120 can interpolate the main area image signals to output a boundary area image signal between the main area image signals. The timing controller 120 can provide the main area image signal and the data signal DATA to the data driver 140. A detailed description of an operation of the timing controller 120 will be described later.

The gate driver 130 can drive the gate lines GL1 to GLn in response to the second control signal CONT2. The gate driver 140 can be implemented by circuits formed at least partially of amorphous silicon gate, oxide semiconductor, amorphous semiconductor, crystalline semiconductor, polycrystalline semiconductor, etc. and can be formed on the same substrate as the display panel 110. The gate driver 130 can also be implemented by a gate driver integrated circuit (IC) and can be electrically connected to one side of the display panel 110.

The data driver 140 can drive the data lines DL1 to DLm according to the data signal DATA and the first control signal CONT1.

Figure 2:
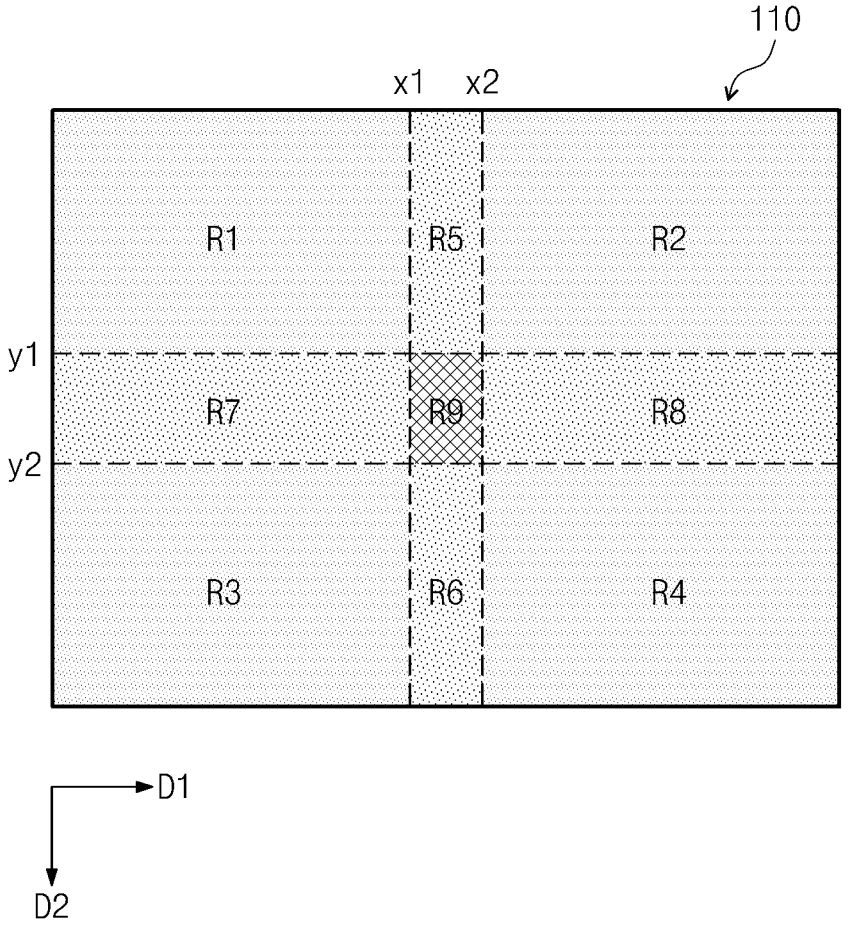
FIG. 2 illustrates an embodiment of a display panel divided into a plurality of main areas.

FIG. 2 illustrates an embodiment of a display panel 110 divided into a plurality of main areas.

Referring to FIG. 2, the display panel 110 includes main areas or regions R1, R2, R3, and R4 and boundary areas R5, R6, R7, R8, and R9. The boundary area R5 can be formed between the main areas R1 and R2, the boundary area R6 can be formed between the main areas R3 and R4, the boundary area R7 can be formed between the main areas R1 and R3, the boundary area R8 can be formed between the main areas R2 and R4, and the boundary area R9 can be formed between the main areas R1 to R4. The number of main areas of the display panel 110 can vary, and the number of boundary areas can vary according to the number of main areas. The boundary areas R5, R9, and R6 can be formed between lines x1 and x2 extending along the second direction D2, and the boundary areas R7, R9, and R8 can be formed between lines y1 and y2 extending along the first direction D1.

When the display panel 110 is divided only into the main areas R1 to R4 without the boundary areas R5 to R9, a brightness difference can arise between the main areas when data is corrected.

Figure 3:
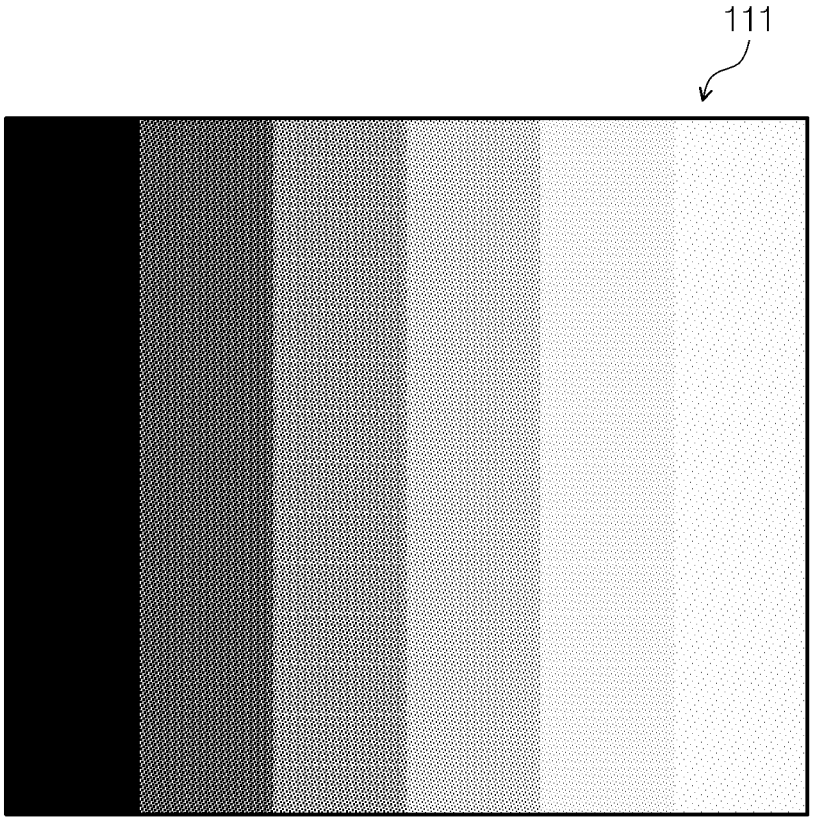
FIG. 3 is a diagram for describing the Mach band effect.

FIG. 3 is a diagram for describing the Mach band effect in typical display panel 111.

Referring to FIG. 3, when monochromatic grey-bands are displayed on the display panel 111 in order of brightness, the brightness difference can be recognized at a boundary where the brightness sharply changes.

Figure 4:
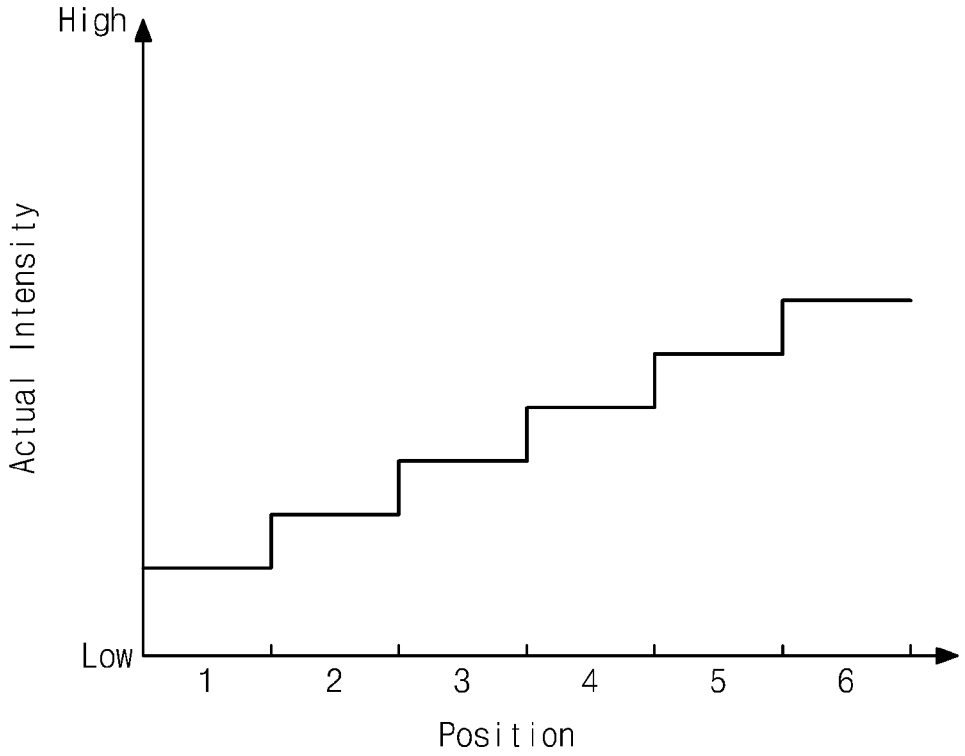
FIG. 4 illustrates gradation of an image signal provided to the display panel shown in FIG. 3.
Figure 5:
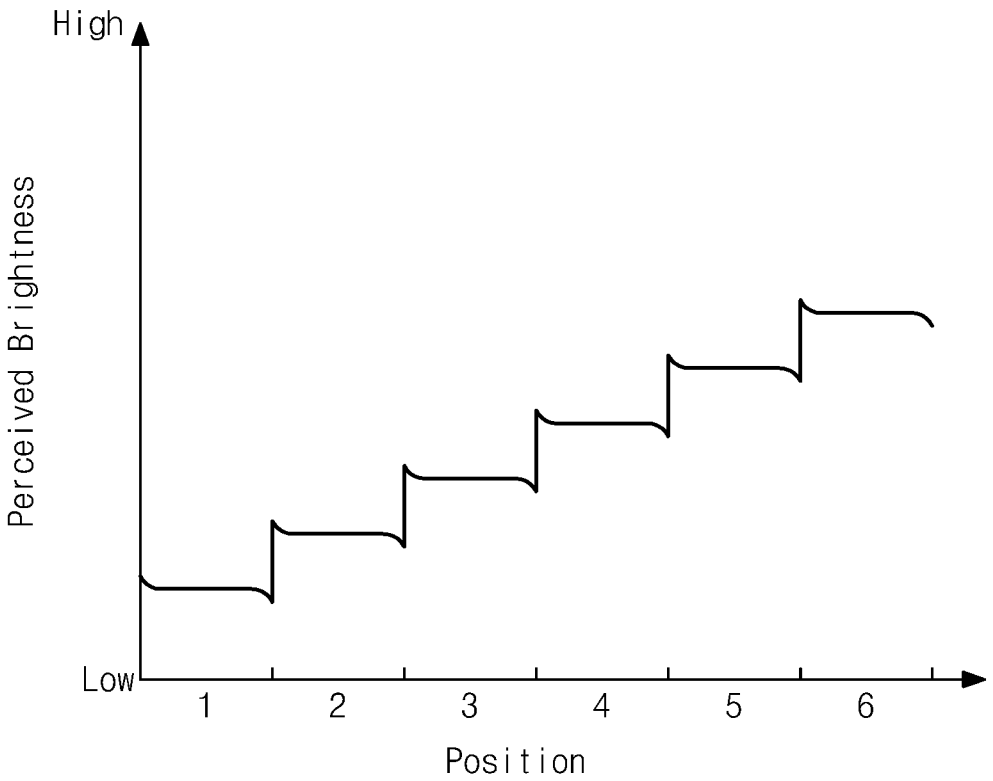
FIG. 5 is a diagram of perceived brightness of an image displayed on the display panel shown in FIG. 3.

FIG. 4 illustrates gradation of an image signal provided to the display panel 111. FIG. 5 is a diagram of perceived brightness of an image displayed on the display panel 111.

Referring to FIGS. 3 to 5, an image signal provided to the display panel 111 vary by stages, while brightness a person perceives can increase or decrease at the boundary. The brightness difference at the boundary can be larger than the brightness difference between surfaces where brightness is constant As illustrated in FIG. 2, the boundary areas R5 to R9 are formed between the main areas R1 to R4. The boundary area image signals are generated by interpolating the main area image signals. Thus, in some embodiments, because the boundary areas R5 to R9 are adjacent to the main areas R1 to R4, sharp variations of brightness are not be perceived.

Figure 6:
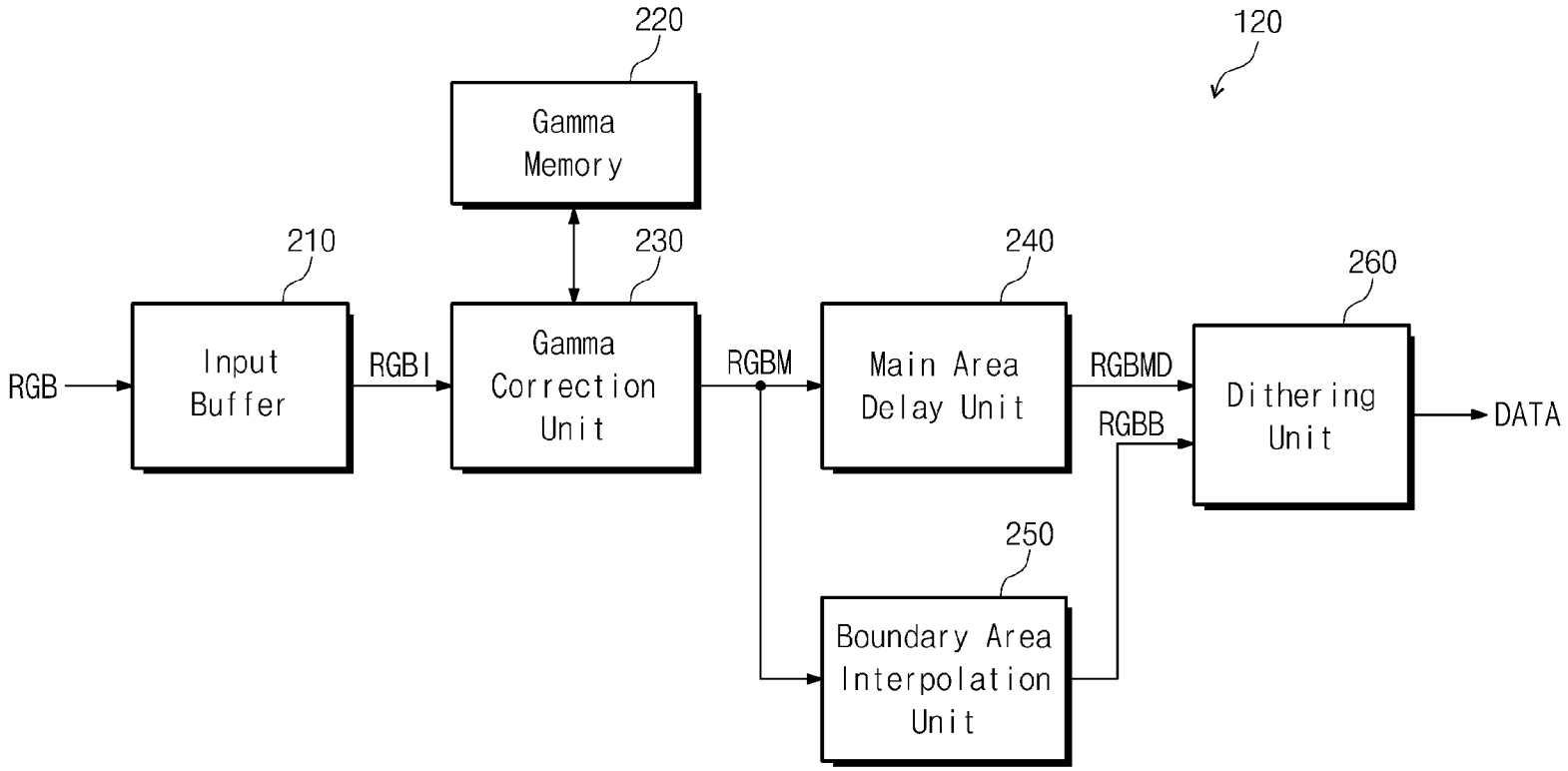
FIG. 6 illustrates the timing controller shown in FIG. 1.

FIG. 6 illustrates the timing controller 120. In FIG. 6, the timing controller 120 includes only an image processor that can convert the image signal RGB into the data signal DATA. However, the embodiments are not limited thereto. For example, the timing controller 120 can further include a circuit that is configured to output the first control signal CONT1 and a second control signal CONT2 in response to the control signal CTRL, as described in reference to FIG. 1.

Referring to FIG. 6, the timing controller 120 can include an input buffer 210, a gamma memory 220, a gamma correction unit 230, a main area delay unit 240, a boundary area interpolation unit or a boundary area interpolator 250, and a dithering unit 260.

The input buffer 210 can store the image signal RGB provided from an external device (not shown) and output an intermediate image signal RGBI. As illustrated in FIG. 2, when the display panel 110 is partitioned into the main areas R1 to R4 and into the boundary areas R5 to R9, the input buffer 210 outputs the intermediate image signal RGBI as an image signal corresponding to the main areas R1 to R4.

The gamma correction unit 230 can perform gamma correction of the intermediate image signal RGBI based at least in part on the gamma memory 220. The gamma correction unit 230 can output a main area image signal RGBM based at least in part on the gamma correction. Pixels PX can comprise a red pixel corresponding to the red color, a green pixel corresponding to the green color, and a blue pixel corresponding to the blue color. When the red, green, and blue pixels have substantially the same optical characteristics, the external device can provide the image signal RGB for the red, green, and blue pixels. However, the optical characteristics of the red, green, and blue pixels can actually be different from one another. In this case, when the image is displayed, the colors perceived by a user can be uneven. Thus, an adaptive color correction (ACC) method can be implemented in which gamma curves of the red, green, and blue pixels are independently changed through gamma correction.

The gamma memory 220 can be implemented by a memory which stores correction data. The correction data can be mapped to the image signal RGB in a one-to-one relationship using a look-up table.

The main area delay unit 240 can delay the main area image signal RGBM to output a delayed main area image signal RGBMD. The boundary area interpolation unit 250 can output a boundary area image signal RGBB based at least in part on the main area image signal RGBM. While the boundary area interpolation unit 250 interpolates the main area image signal RGBM, the main area delay unit 240 can delay the main area image signal RGBM. The dithering unit 260 can output the data signal DATA by dithering the delayed main area image signal RGBMD and the boundary area image signal RGBB. The data signal DATA can be provided to the data driver 140. Operations of the boundary area interpolation unit 250 and the dithering unit 260 will be described later.

Figure 7:
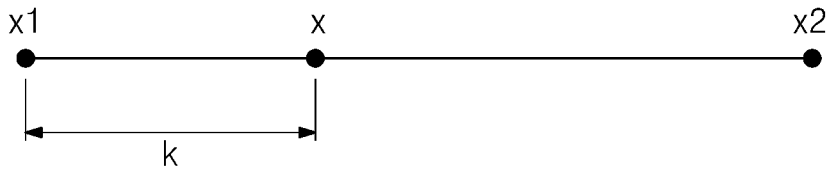
FIG. 7 is a diagram for describing an operation of a boundary area interpolation unit shown in FIG. 6.

FIG. 7 is a diagram for describing an operation of the boundary area interpolation unit 250.

Referring to FIGS. 2 and 7, for example, the boundary area image signal RGBB corresponding to a predetermined position x in a boundary area R5 of a display panel 110 is obtained from the following equation (1) associated with cosine interpolation.

$$RGBB = m1 + (m2 - m1) \times \frac{\left[1 - \cos\left(\frac{k \times \pi}{m2 - m1}\right)\right]}{2} \tag{1}$$

In the equation (1), m1 indicates an image signal of a first position x1 in the main area R1, m2 indicates an image signal of a second position x2 in the main area R2, and x indicates a predetermined position.

The boundary area interpolation unit 250 can obtain the boundary area image signal RGBB using linear interpolation instead of cosine interpolation. The following equation (2) can be used to calculate an image signal F(x, y) of the boundary areas R5 to R9 through linear interpolation.

$$F(x, y) = \tag{2}$$

$$\begin{cases} F_1, & \text{if } x \le x_1 \text{ and } y \le y_1 \\ F_2, & \text{if } x \ge x_2 \text{ and } y \le y_1 \\ F_3, & \text{if } x \le x_1 \text{ and } y \ge y_2 \\ F_4, & \text{if } x \ge x_2 \text{ and } y \le y_2 \\ F_1 + \frac{x}{x_2 - x_1}(F_2 - F_1), & \text{if } x_1 < x < x_2 \text{ and } y \le y_1 \\ F_3 + \frac{x}{x_2 - x_1}(F_4 - F_3), & \text{if } x_1 < x < x_2 \text{ and } y \ge y_2 \\ F_1 + \frac{y}{y_2 - y_1}(F_3 - F_1), & \text{if } x \le x_1 \text{ and } y_1 < y < y_2 \\ F_2 + \frac{y}{y_2 - y_1}(F_4 - F_2), & \text{if } x \ge x_2 \text{ and } y_1 < y < y_2 \\ F_1 + \frac{x}{x_2 - x_1}(F_2 - F_1) + \frac{y}{y_2 - y_1}(F_3 - F_1) + \frac{xy}{(x_2 - x_1)(y_2 - y_1)}(F_1 + F_4 - F_2 - F_3), & \text{if } x_1 < x < x_2 \text{ and } y_1 < y < y_2 \end{cases}$$

In the equation (2), x indicates a position on the display panel 110 in the first direction D1, and x1 and x2 indicate the width of one of the boundary areas R5 to R9 in the first direction D1. y indicates a position on the display panel 110 in the second direction D2, and y1 and y2 indicate the height of one of the boundary areas R5 to R9 in the second direction D2. $F_1$, $F_2$, $F_3$ and $F_4$ respectively indicate image signals of the main area R1 to R4.

Figure 8:
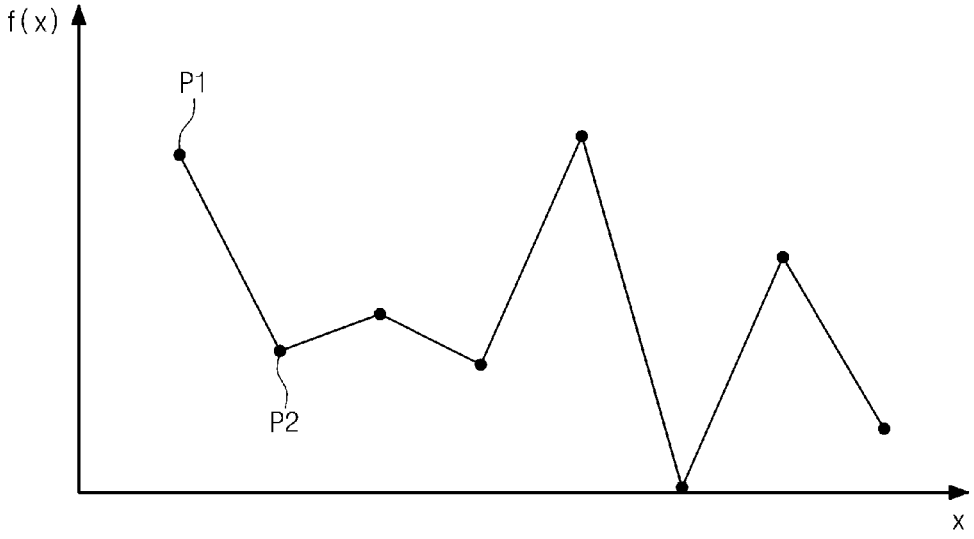
FIG. 8 is a diagram for describing linear interpolation.
Figure 9:
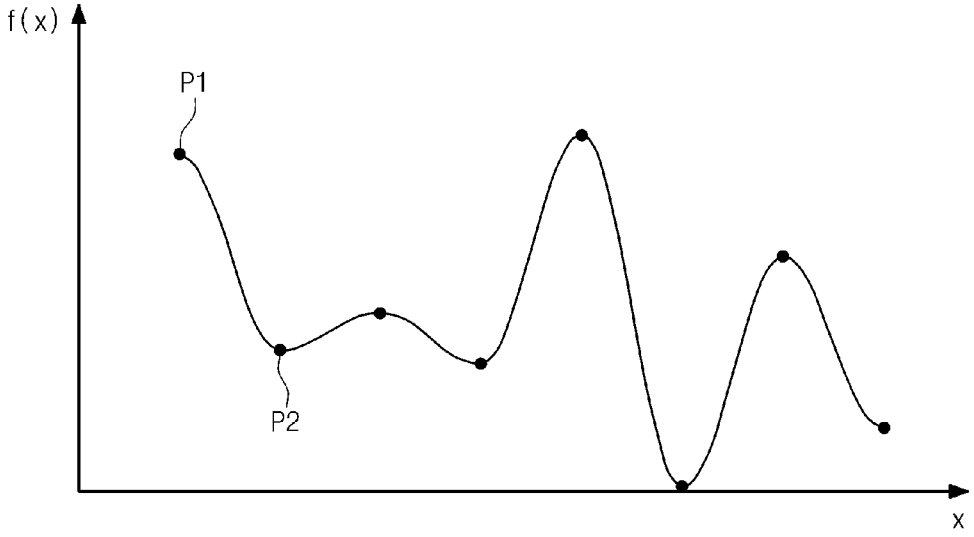
FIG. 9 is a diagram for describing cosine interpolation.

FIG. 8 is a diagram for describing linear interpolation. FIG. 9 is a diagram for describing cosine interpolation.

Referring to FIG. 8, linear interpolation is used to estimate a function value $f(x)$ of any position between two points P1 and P2. For example, the function value $f(x)$ can be estimated by connecting the points P1 and P2 in a straight line.

Referring to FIG. 9, cosine interpolation can be used to estimate a function value $f(x)$ of any position between two points P1 and P2. For example, the function value $f(x)$ can be estimated by connecting the points P1 and P2 by a cosine curve.

In the linear interpolation, because $f(x)$ is not differentiable, stepwise discontinuity described with reference to FIG. 4 can appear at an image signal obtained by the interpolation.

In the cosine interpolation, because $f(x)$ is differentiable, the stepwise discontinuity does not appear in the image signal obtained by the interpolation. Therefore, the user does not perceive a lightness difference due to the Mach band effect.

Figure 10:
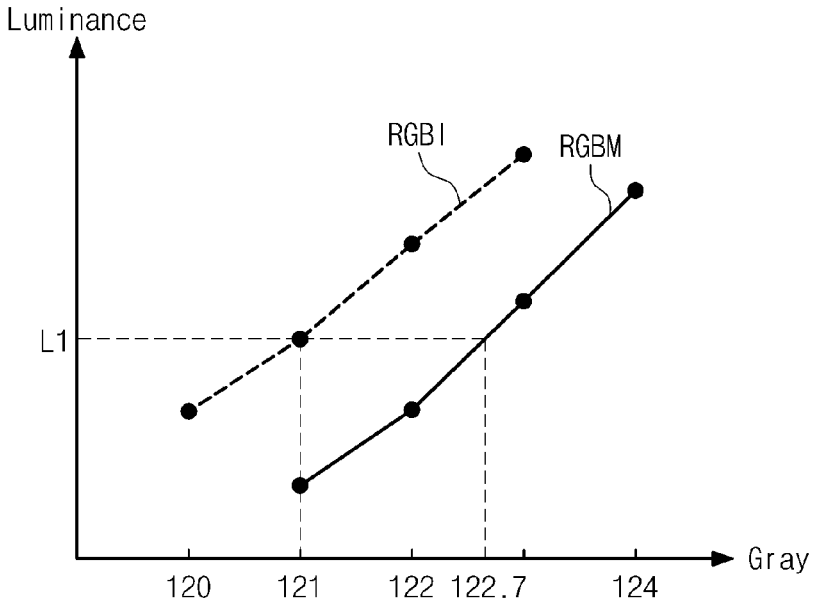
FIGS. 10 and 11 are diagrams for describing an adaptive color correction method of the timing controller shown in FIG. 6.
Figure 11:
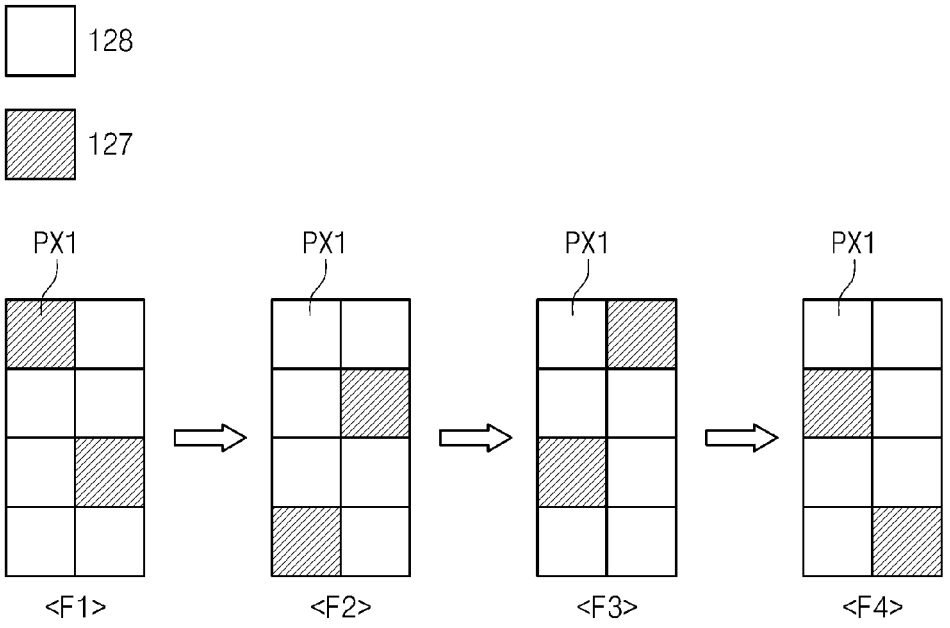

FIGS. 10 and 11 are diagrams for describing the ACC method of the timing controller 120 shown in FIG. 6.

The following Table 1 shows an example relationship between the intermediate image signal RGBI and the main area image signal RGBM.

TABLE 1

| RGBI | RGBM |
|---|---|
| 120 | 122.0 |
| 121 | 122.7 |
| 122 | 123.5 |
| 123 | 124.3 |
| 124 | 125.3 |

For example, when the intermediate image signal RGBI has a width of 8 bits whose value is 121, the gamma correction unit 230 outputs the main area image signal RGBM that has a width of 10 bits whose value is 122.7. When the bit width of the main area image signal RGBM is expanded to 10 bits after performing the ACC, the dithering unit 260 converts the 10 bits of the delayed main area image signal RGBMD into 8 bits because the bit width of the data signal DATA is fixed to 8 bits.

Referring to FIG. 11, a first pixel PX1 of eight pixels (in a 2×4 configuration) of the display panel 110 is shown. The first pixel PX1 displays a partial image corresponding to a 127 gradation in a first frame F1, a partial image corresponding to a 128 gradation in a second frame F2, a partial image corresponding to the 128 gradation in a third frame F3, and the partial image corresponding to the 128 gradation in a fourth frame F4. Substantially the same effect as a partial image corresponding to a 127.75 ((127+128+128+128)/4) gradation is displayed in the eight pixels of the display panel 110. That is, substantially the same effect as a 10-bit main area image signal RGBM is output by the 8-bit data signal DATA over four frames.

Figure 12:
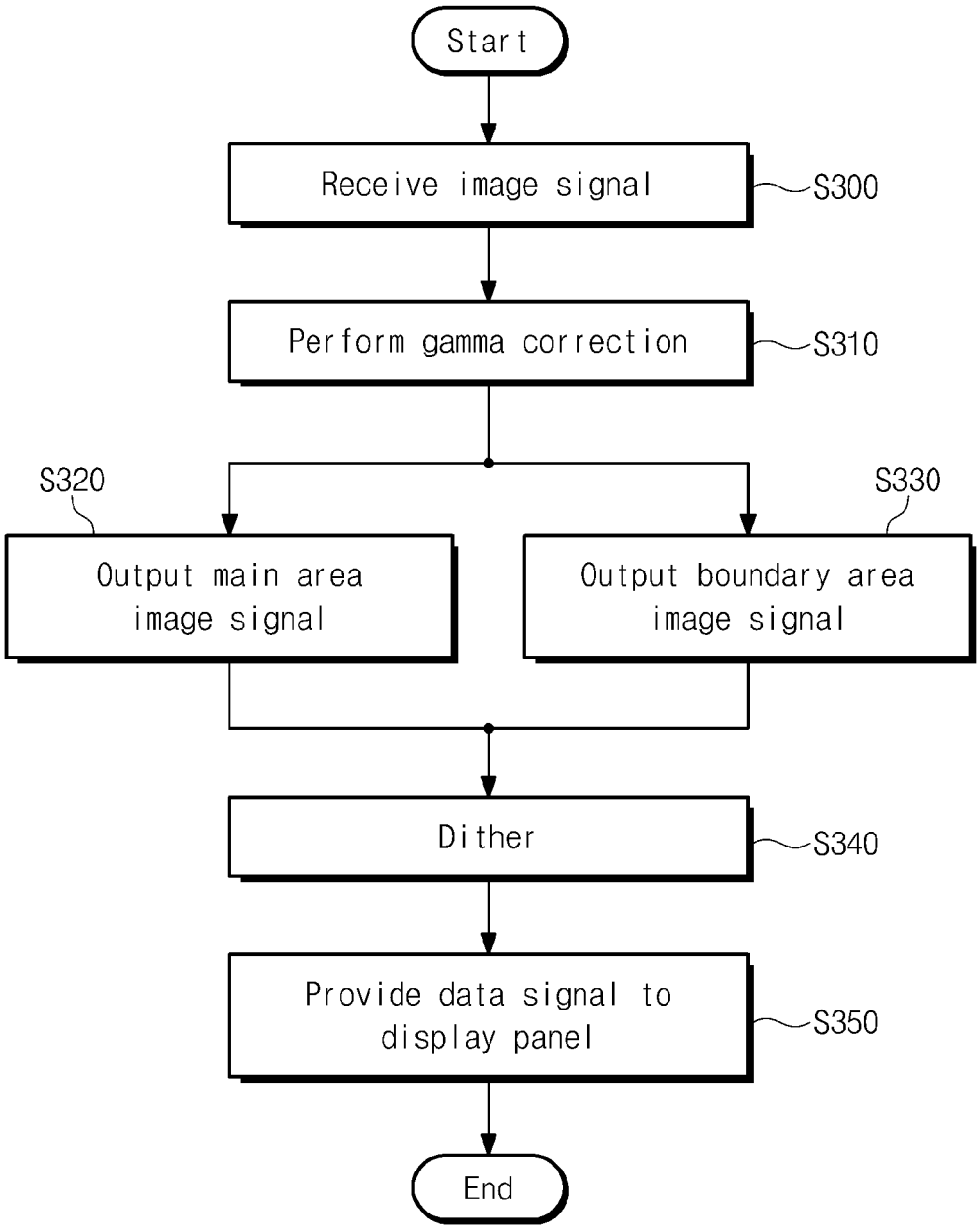
FIG. 12 is a flow chart of a driving method of a display device according to an exemplary embodiment.

FIG. 12 is a flow chart of a driving method of the display device 100 according to an embodiment.

In some embodiments, the FIG. 12 procedure is implemented in a conventional programming language, such as C or C++ or another suitable programming language. The program can be stored on a computer accessible storage medium of the display device 100, for example, a memory (not shown) of the display 100 or the timing controller 120. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 7/Vista/2000/9x/ME/XP, Macintosh OS, OS/2, Android, iOS and the like. In another embodiment, at least part of the procedure can be implemented with embedded software. Depending on the embodiment, additional states can be added, others removed, or the order of the states changed in FIG. 12.

Referring to FIGS. 1, 6, and 12, in step S300, the input buffer 210 receives and stores the image signal RGB from the external device. The input buffer 210 outputs the intermediate image signal RGBI. As illustrated in FIG. 2, when the display panel 110 is partitioned into the main areas R1 to R4 and into the boundary areas R5 to R9, the input buffer 210 outputs the image signal RGB corresponding to the main areas R1 to R4 as the intermediate image signal RGBI.

In step S310, the gamma correction unit 230 performs the gamma correction on the intermediate image signal RGBI using the gamma memory 220.

In step S320, the gamma correction unit 230 outputs the main area image signal RGBM. While the boundary area interpolation unit 250 calculates the boundary area image signal RGBB, the main area delay unit 240 delays the main area image signal RGBM and outputs the delayed main area image signal RGBMD.

In step S330, the boundary area interpolation unit 250 interpolates the main area image signal RGBM and outputs the boundary area image signal RGBB as a result of the interpolation.

In step S340, the dithering unit 260 outputs the data signal DATA. The data signal DATA is a result of dithering the delayed main area image signal RGBMD and the boundary area image signal RGBB. The data signal DATA is provided from the dithering unit 260 to the data driver 140.

While the inventive aspects have been described with reference to exemplary embodiments, it will be apparent to those skilled in the art that various changes and modifications can be made without departing from the spirit and scope of the present invention. Therefore, it should be understood that the above embodiments are not limiting, but illustrative.

What is claimed is:

1. A method of driving a display device, comprising:

receiving an image signal;

gamma correcting the image signal into at least one main area image signal;

interpolating the gamma corrected main area image signal into a boundary area image signal;

dithering the main area image signal and the boundary area image signal into a data signal; and providing the data signal to a display panel.

2. The method of claim 1, wherein the main area image signal comprises first and second main area image signals respectively corresponding to first and second main areas of the display panel.

3. The method of claim 2, wherein at least one boundary area is interposed between the first and second main areas.

4. The method of claim 3, wherein the boundary area image signal is displayed on the boundary area.

5. The method of claim 4, wherein the interpolating comprises:

performing cosine interpolation based on the first and second main area image signals and a distance between the first main area and the boundary area.

6. The method of claim 5, wherein the performing of the cosine interpolation comprises:

calculating the boundary area image signal (RGBB) based on the following equation:

$$RGBB = m1 + (m2 - m1) \times \frac{\left[1 - \cos\left(\frac{k \times \pi}{m2 - m1}\right)\right]}{2}$$

wherein m1 indicates the first main area image signal, m2 indicates the second main area image signal, and k indicates the distance between the first main area and the boundary area.

7. The method of claim 1, further comprising delaying the main area image signal into a delayed main area image signal.

8. The method of claim 7, wherein the dithering comprises dithering the delayed main area image signal and the boundary area image signal into the data signal as a dithering result.

9. An image processor, comprising:

an input buffer configured to receive an image signal and output an intermediate image signal corresponding to at least one main area of a display panel;

a gamma correction unit configured to perform a gamma correction on the intermediate image signal so as to generate a main area image signal;

an interpolator configured to interpolate the main area image signal generated by the gamma correction unit so as to generate a boundary area image signal; and a dithering unit configured to dither the main area image signal and the boundary area image signal into a data signal.

10. The image processor of claim 9, further comprising:

a delay unit configured to delay the main area image signal and output a delayed main area image signal, wherein the dithering unit is further configured to dither the delayed main area image signal and the boundary area image signal.

11. The image processor of claim 9, wherein the main area image signal comprises first and second main area image signals respectively corresponding to first and second main areas.

12. The image processor of claim 11, wherein a boundary area is at the boundary of the first and second main areas.

13. The image processor of claim 12, wherein the boundary area image signal is configured to be displayed on the boundary area.

14. The image processor of claim 13, wherein the interpolator is further configured to perform cosine interpolation based on the first and second main area image signals and a distance between the first main area and the boundary area.

15. The image processor of claim 14, wherein the interpolator is further configured to calculate the boundary area image signal (RGBB) based on the following equation:

$$RGBB = m1 + (m2 - m1) \times \frac{\left[1 - \cos\left(\frac{k \times \pi}{m2 - m1}\right)\right]}{2}$$

wherein m1 indicates the first main area image signal, m2 indicates the second main area image signal, and k indicates the distance between the first main area and the boundary area.

16. The image processor of claim 9, further comprising:

a gamma memory configured to store a gamma correction value, wherein the gamma correction unit is configured to output the main area image signal based on the gamma correction value stored in the gamma memory.

17. A display device, comprising:

a display panel; and an image processor configured to process an image to be displayed on the display panel, wherein the image processor comprises:

an input buffer configured to receive an image signal and output an intermediate image signal corresponding to at least one main area of a display panel;

a gamma correction unit configured to perform a gamma correction on the intermediate the image signal so as to generate a main area image signal;

an interpolator configured to interpolate the main area image signal generated by the gamma correction unit so as to generate a boundary area image signal; and a dithering unit configured to dither the main area image signal and the boundary area image signal so as to output a data signal.

18. The display device of claim 17, wherein the image processor further comprises:

a delay unit configured to delay the main area image signal, wherein the dithering unit is further configured to dither the delayed main area image signal and the boundary area image signal.

19. The display device of claim 18, wherein the main area image signal comprises first and second main area image signals respectively corresponding to first and second main areas of the display panel.

20. The display device of claim 19, wherein a boundary area is interposed between the first and second main areas.

21. The display device of claim 20, wherein the display panel is configured to display the boundary area image signal on the boundary area.

22. The display device of claim 17, wherein the interpolator is further configured to perform cosine interpolation based on the first and second main area image signals and a distance between the first main area and the boundary area.

23. The display device of claim 17, wherein the interpolator is configured to calculate the boundary area image signal (RGBB) based on the following equation:

$$RGBB = m1 + (m2 - m1) \times \frac{\left[1 - \cos\left(\frac{k \times \pi}{m2 - m1}\right)\right]}{2}$$

wherein m1 indicates the first main area image signal, m2 indicates the second main area image signal, and k indicates the distance between the first main area and the boundary area.

24. The display device of claim 17, wherein the image processor further comprises:

a gamma memory configured to store a gamma correction value, wherein the gamma correction unit is configured to output the main area image signal based on the gamma correction value stored in the gamma memory.

25. A display device, comprising:

a display panel including at least one main area and at least one boundary area, wherein the display panel is configured to display a main area image signal on the main area and a boundary area image signal on the boundary area; and an image processor configured to gamma correct the main area image signal and interpolate the gamma corrected main area image signal so as to generate the boundary area image signal.

26. The display device of claim 25, wherein the image processor comprises:

an input buffer configured to receive an image signal;

a gamma correction unit configured to perform a gamma correction on the image signal; and an interpolator configured to interpolate the main area image signal and generate the boundary area image signal.

27. The display device of claim 26, wherein the image processor further comprises:

a main area delay unit configured to delay the main area image signal; and a dithering unit configured to dither a delayed main area image signal and the boundary area image signal and provide the dithering signal to the display panel.

28. The image processor of claim 26, wherein the interpolator is further configured to perform cosine interpolation based on the first and second main area image signals and a distance between the first main area and the boundary area.

* * * * *